United States Patent [19]

Laws et al.

[11] Patent Number: 4,531,776

[45] Date of Patent: Jul. 30, 1985

[54] SAFETY CAB FOR UNDERGROUND MINING EQUIPMENT

[75] Inventors: Dee G. Laws, Price, Utah; Frank A. Scavo, Rte. #1, Box 157, Helper, Utah 84526; E. Wayne Laws, Price; Frank R. Scavo, Helper, both of Utah

[73] Assignee: Frank A. Scavo, Helper, Utah ; a part interest

[21] Appl. No.: 565,863

[22] Filed: Dec. 27, 1983

[51] Int. Cl.[3] ..... B62D 33/06

[52] U.S. Cl. ..... 296/190; 180/89.12; 180/89.13

[58] Field of Search ..... 296/190, 187, 188, 203; 180/89.1, 89.13, 89.12, 89.14, 89.16; 299/12

[56] References Cited

U.S. PATENT DOCUMENTS

| | | | |
|---|---|---|---|
| 3,977,489 | 8/1976 | Cole et al. | 180/89.1 |
| 4,065,167 | 12/1977 | Wright | 296/190 |
| 4,078,629 | 3/1978 | Kutay et al. | 296/190 |
| 4,085,815 | 4/1978 | Miller | 180/89.1 |
| 4,106,815 | 8/1978 | Dunn | 299/12 |

*Primary Examiner*—Robert R. Song

*Attorney, Agent, or Firm*—K. S. Cornaby

[57] ABSTRACT

An operator's safety cab for an underground continuous miner for coal and the like has a cage constructed of triangular-shaped tubing to provide for torsional rigidity and a shearing edge for material falling on the cab from roof or wall cave-ins. The cab has a canopy with a plurality of angled surfaces and a frontal angled screened section for deflection of falling material and protection from crushing material. The cab also has a cab door supported by the edges of the cab and has six support standards of triangular cross-section to support the canopy and frontal section. The sides and door of the cab are screened with heavy mesh screens to further protect the operator.

10 Claims, 9 Drawing Figures

SAFETY CAB FOR UNDERGROUND MINING EQUIPMENT

BACKGROUND OF THE INVENTION

This invention relates to the field of safety cabs for underground mining equipment.

The underground coal mining's industry is faced with a continuing threat to personal safety, namely, the ever present danger of mine roof and sidewall cave-ins. As a result, the federal government has promulgated a number of rules and regulations governing mine safety equipment and operations. These federal underground mining regulations are not continuously changed to meet the methods of coal extraction which are developed out of necessity to meet the demands of new coal finds, primarily in the western United States regions. For example, the location of 30 foot seams demands more strict regulations than are presently in effect.

The Federal Mine Safety Health Administration now regards standard manufactured cabs for continuous coal miners which are on the market as having definite limitations with respect to safety. New safety criteria for mining under high roofs need to be developed and cabs need to be designed for such mining conditions. As the Mine Safety and Health Administration notes, "a cab may give a false sense of security to an operator who believes it capable of withstanding a massive roof fall."

The structure of presently available cabs for continuous coal miners below ground is deficient in being able to withstanding massive roof or lateral roof falls which can crush the cab and trap the operator inside.

Specifically, present mining conditions require a safety enclosure for cabs which will protect the operator from both vertical and lateral falls. The cab should be designed in such a way that the cab, door, and upright standards are designed with triangular tubular steel which acts as a fulcrum when contact is made by a collapsing roof or rib wall.

The cab door should provide a unique tie-in effect with the cab when in the closed position. This would allow maximum support to the hinges, a feature which is not now available.

The angulation of the front portion of the cab should allow any falling coal or rock to slide off the cab after impact and not permit full, flat surface contact to take place.

The crown of the canopy of the cab should likewise be angled to offer something other than a full, flat surface contact with any falling material.

The upright standards of the cab should provide an offsetting force to lateral blows from sidewall falls to permit the fulcrum effect to come into play and prevent shearing of the standards.

While most present cab canopies are anchored at four points on the continuous miner, greater safety demands at least an additional two frontal anchors to the canopies.

An extended front design pattern would protect a methane detector located within the cab.

The cab should be enclosed on all sides with adequate rolled screen to protect the operator from small coal and rock particles. The cab should also be enclosed in the front with heavy rolled screen to protect the operator from the larger chunks of coal and rock falling on the cab during regular coal extraction procedure.

SUMMARY OF THE INVENTION

The above noted objectives are accomplished in a new safety cab design which is set forth herein, in which a safety cab is provided constructed of triangular steel tubing, heavy steel screen and preferably ¾" metal plate. The canopy of the cab is a six-sided structure preferably constructed of ¾" thick steel plate with 2 slopes. The top side of the canopy is framed by preferably 1½" triangular tubing which support five 1½" triangular tubes lacing the inner surface. These triangular structures provide breaking surfaces to contact any vertically falling material and to provide added strength to the base plate of the canopy. The presence of the triangular tube lacing at the top of the canopy provides no flat-to-flat surface contact with any falling debris. The underside of the canopy is outlined with preferably 2½" triangular tubing with an inverse inside lacing of the top surface with 1½" triangular tubing.

Attached to the underside rear corner of the cab canopy is a 2½" inside diameter triangular sleeve, 6" long which is designed to house the 2½" outside diameter triangular tube upright standard. The standard is held in the sleeve by two ⅝" diameter set screws and the weight of the canopy itself. The set screws are tightened to exert pressure against the standards thereby holding them securely in place.

The main vertical support consists of four 2½" outside diameter triangular tubing standards. The standards are attached to the canopy by four 2½" inside diameter 6" long sleeves which are welded to the underside of the canopy. The bottom of these standards are housed in four 2½" inside diameter 6" long sleeves which are welded to the main frame of the continuous miner machine. The four standards are then held securely in the eight sleeves by two ⅝" diameter set screws in each of the eight sleeves. The triangular standards are designed to offer elasticity and three breaking edges. The tubing offers breaking surfaces as well as horizontal and vertical elasticity.

The frontal sloping area consists of two outside sloping supports of 2½" outside diameter triangular tubing and two center supports of 1½" outside diameter triangular tubing. A protective screen for the operator is afforded by a shelf of 2½" expanded metal which rests on top of the aforementioned tubing. Above the screen is an inverse lacing of triangular tubing of 1½" outside dimension which matches the lower side screen. This again eliminates a flat surface contact and provides breaking edges for any falling debris. Along with the four vertical standards, the two sloping frontal supports give the cab six anchor points to the main frame of the continuous coal miner.

The vertical ladder on the right of the operator runs from the main frame to the canopy main frame. This affords a seventh anchor point for the canopy. The vertical ladder consists of two 1½" vertical triangular tubes spaced approximately 6" apart with horizontal 1½" triangular tubes spaced on 6" centers from the top to the bottom. This affords the operator protection and entrance access for the maching power cable.

The left side of the cab which is adjacent to the conveyor boom of the coal miner is covered with 1" metal mesh screen attached to the standard sleeves. This provides the operator with protection from material being carried on the conveyor next to the cab, and also provides the operator adequate visability. Located below this screen is a 1½" metal plate which is the main frame of the continuous coal miner.

The cab door is constructed of 1½" outside diameter triangular tubing which provides a framework with inner supports running both horizontally and vertically. The interior is covered with 1" metal mesh screen as is found on the left side of the cab. The door stop itself is a three focal point contact. The first is the top slant triangular tube, the second is the top triangular tube, and the third is the contact of the door with the step on a standard continuous coal miner at the rear of the cab near the step ladder. The first two focal points make full contact with the canopy allowing a flush contact with no opportunity to bend or sag. A door lock which keeps the door from falling open or crushing inward also provides a convenient fourth door stop. This lock is a drop pin system with eyelet mounts secured to the main frame and the door with a 1" solid locking drop pin. The door is hinged by a round tubing and a 1⅛" hinge pin toward the front of the cab. The door together with the frontal standards provides the same fulcrum effect on horizontal matter falling from the walls and striking the cab. Flush surface contact with such debris is not permitted to occur. The mesh screen prevents small material from causing any harm to the operator.

The over all effects of this unit due to triangular steel tubing structure coupled with metal mesh screen and the seven anchor points cause a breaking up of any falling material and does not permit any full surface contact with the cab. This in turn provides the operator with maximum protection available. The triangular steel tubing also affords elasticity against vertical and horizontal falls of underground material when mining operations are in process. It also provides complete protection for all of the machine operating controls as well as an escape route for the operator in the event of a fall between the two rear standards of the canopy.

THE DRAWING

A preferred embodiment of the invention is shown in the attached drawing, in which:

FIG. 1 is a side elevational view of an underground continuous coal miner showing the safety cab of the invention in place on the miner;

FIG. 2, a side elevational view of the safety cab showing the entrance door;

FIG. 3, a top plan view of the safety cab;

FIG. 4, a rear elevational view of the safety cab;

FIG. 5, a front elevational view of the safety cab;

FIG. 6, a sectional view of the cab canopy taken along line 6—6 of FIG. 2;

FIG. 7, a top plan sectional view of a tubular triangular standard taken along line 7—7 of FIG. 4;

FIG. 8, a top plan sectional view of the door screen and supports taken along line 8—8 of FIG. 2; and FIG. 9, a sectional view of the frontal screen and side supports of the canopy taken along line 9—9 of FIG. 2.

DETAILED DESCRIPTION OF THE ILLUSTRATED EMBODIMENT

Figure 1:
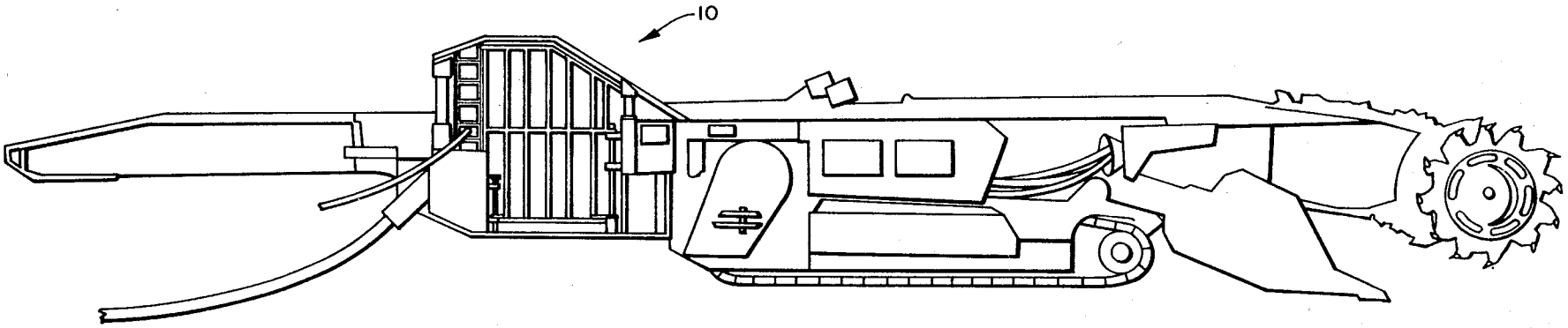

As shown in FIG. 1, a cab 10 of the invention is illustrated in place in a continuous underground miner of standard construction.

Figure 3:
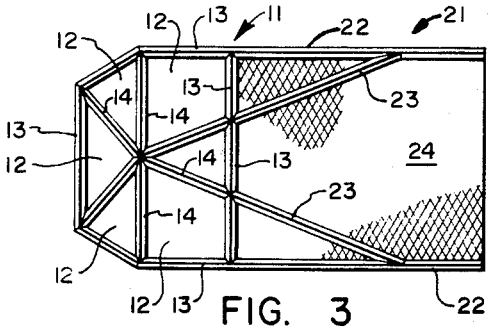
Figure 4:
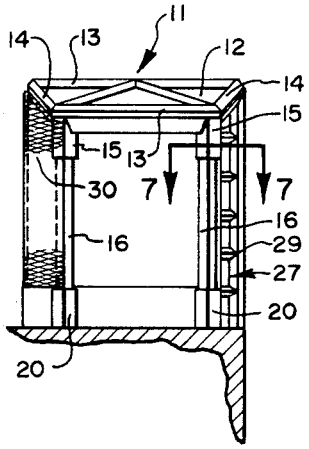
Figure 2:
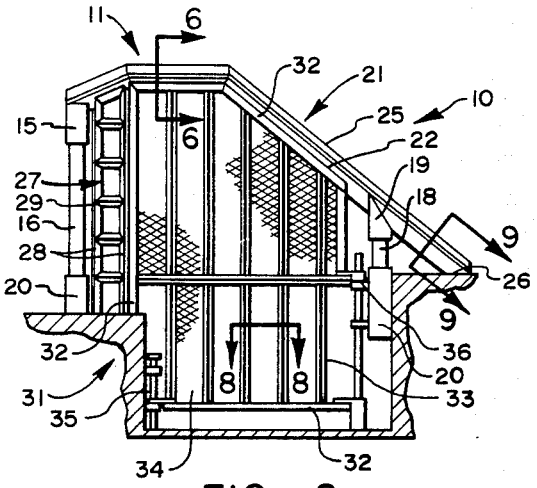
Figure 5:
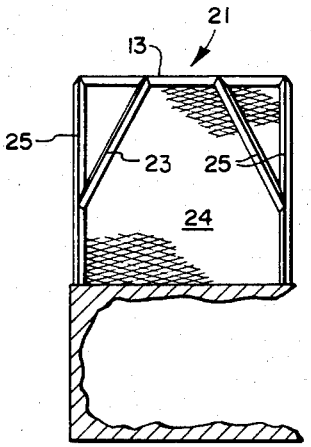
Figure 6:
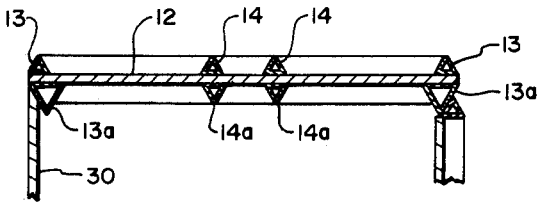

Cab 10 is also illustrated in FIG. 2, with cap canopy 11 being shown in FIGS. 3, 4 and 5. Cap canopy 11 is a six-sided structure fabricated in this embodiment of ¾" thick steel plate 12 with a horizontal top center portion and forward and rear sloped portions. The top center portion of the canopy is framed by 1½" triangular tubing 13 which supports 1½" triangular-shaped tubes 14 supporting the inner surface 12. The importance of the triangular-shaped tubing 13, 14 is to provide breaking edges to contact and help break up vertically falling material from roof cave-ins and the like. The structures also provide added strength to the canopy base plate 12. The underside of canopy 11, shown in FIG. 6, is preferably outlined with 2½" triangular tubing **13*a* with inverse crossing of lower mounted 1½" triangular tubing 14*a***.

Figure 7:
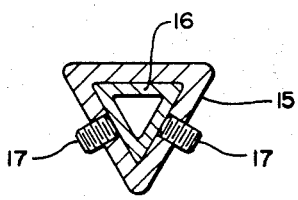
Figure 8:
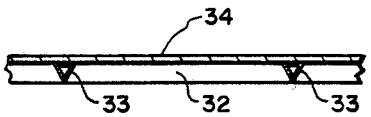
Figure 9:
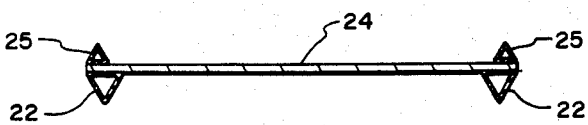

As shown in FIGS. 2, 4 and 7, a 2½" inside diameter sleeve 15 (6" long) is attached to the respective rear corners of canopy 11 to house the top of a 2½" outside-diameter triangular tube upright support standard 16 in each rear corner of cab 10. Set screws 17 and the weight of canopy 11 hold standards 16 in place within sleeves 15.

In addition, two front-mounted standards 18 are attached to canopy 11 in the same manner as the rear-mounted standards 16, namely, with canopy-mounted sleeves 19. Each of the four standards 16, 18 are attached to the continuous miner by means of a set of four sleeves 20 mounted on the surface of the continuous miner. Set screws (not shown) in each of the sleeves secure the bottoms of the standards 16, 18 in place. The use of triangular-shaped standards of the dimension of 2½" outside diameter provide needed horizontal and rotational elasticity and desirable breaking edges when hit by falling material.

Attached to the top canopy 11 is a frontal sloping section 21, as shown in FIGS. 2, 3, and 5. This provides the forward viewing area of the operator of the cab 10. Frontal section 21 is framed in this embodiment by a pair of 2½" diameter triangular tubes 22 which in turn support a pair of center support ribs (not shown) constructed of 1½" diameter tubing. This is covered by a protective screen of close-mesh 24 and a system of 1½" diameter triangular tubing 25 corresponding to the underside of frontal section 21 described above. Two additional frontal supports 26 located at the front of the frontal section 21 are the forward ends of triangular-shaped support tubes 22 resting upon the top surface of the continuous miner. These two supports 26 coupled with the other four supports 16, 18 provide six major support points between cab 10 and the continuous miner.

As shown in FIGS. 2 and 4, a vertical ladder 27 extends from the surface of the continuous miner to the canopy 11 of cab 10. Ladder 27 therefore also provides a seventh support point between cab 10 and the main frame of the continuous miner. Ladder 27 has two vertically extending 1½" diameter triangular tubes 28 spaced approximately 6" apart with a plurality of horizontally extending 1½" diameter triangular tubes 29 spaced on 6" centers as rungs for ladder 27.

As illustrated in FIG. 4, the left side of cab 10 is covered with a 1" metal mesh screen 30 attached to the standard sleeves 15, 19, 20. The screen 30 protects the operator from falling material and from material being carried next to the cab on the conveyor running from the front of the continuous miner to the rear.

Entrance to cab 10 is gained through a cab door 31 located on the right side of the cab forward of the ladder 27. Door 31 has an outside framework 32 of 1½" diameter triangular tubing and a plurality of vertically extending interior support members 33 constructed preferably of the same material. The entire door 31 is covered with 1" metal mesh screen 34, which is the same as on the left side of cab 10. The uppermost door perimeter tubes 32 make full contact with canopy 11 and forward portion 21 thereby eliminating bending or sagging. At the bottom, door 31 makes contact with the step located on a standard continuous coal miner at the rear of the cab 10 near ladder 27.

A door locking device 35 is provided at the lower rear corner of door 31 comprising in this embodiment a drop pin system with eyelet mounts attached to the main frame and the door with a 1" solid locking drop in. This keeps the door from falling open or crushing inward, and provides an additional door stop. Door 31 is forwardly hinged with a hinge system 36 having round tubing and a $1\frac{1}{8}$" hinge pin. Door 31 provides a fulcrum effect with front standards 18 in preventing horizontally moving material from entering cab 11, since flush surface contact with the cab is not permitted to occur.

While this invention has been described and illustrated with respect to a particular embodiment, it should be understood that there are other embodiments which will become apparent to those skilled in the art, and, accordingly, the scope of the invention is set forth in the accompanying claims.

We claim:

1. Safety cab for underground continuous miner, comprising in combination:

a rectangular cab frame constructed of triangular cross-section tubing and enclosed in heavy metal mesh screen, and adopted for mounting on a continuous miner;

a cab canopy attached to the top of said frame constructed of triangular cross-section tubing and plate metal, said canopy having a plurality of surface planes;

a frontal view section disposed at the forward end of said cab frame and attached to said canopy, said frontal section being constructed of triangular cross-section tubing and heavy metal mesh screen;

a plurality of upright supports disposed at the corners of said cab frame constructed of triangular cross-section tubing extending from said canopy downwardly to rest on the continuous miner for support;

door means attached to said cab frame for entrance to said cab, said door means constructed of triangular cross section tubing and covered with heavy metal mesh screen, said door means constructed so as to support said cab frame when in the closed position; and each of said triangular cross-section tubings having an outwardly exposed edge having the function of breaking up any falling material hindering full-surface contact with the cab.

2. Safety cab as set forth in claim 1, including ladder means attached to said frame constructed of triangular cross-section tubing.

3. Safety cab as set forth in claim 1, wherein said door means is hingedly attached to said cab frame and is lockable.

4. Safety cab as set forth in claim 1, wherein said triangular cross-section tubing has from $1\frac{1}{2}$" to $2\frac{1}{2}$" diameter.

5. Safety cab as set forth in claim 1, wherein said heavy metal mesh screen is 1" mesh screen.

6. Safety cab as set forth in claim 1, wherein said canopy has two planar surfaces.

7. Safety cab as set forth in claim 1, wherein there are at least four upright support standards.

8. Safety cab as set forth in claim 1, wherein said canopy has triangular support tubing both below and above the plate metal.

9. Safety cab as set forth in claim 1, wherein said cab is constructed so as to be detachable from the continuous miner.

10. Safety cab as set forth in claim 1, wherein said frontal section has triangular support tubing both below and above said heavy metal mesh screen.

* * * * *